US009114894B2

(12) United States Patent
Monti

(10) Patent No.: US 9,114,894 B2
(45) Date of Patent: Aug. 25, 2015

(54) APPARATUS FOR INSERTING ARTICLES INTERNALLY OF BOXES

(71) Applicant: Marchesini Group S.p.A., Pianoro (Bologna) (IT)

(72) Inventor: Giuseppe Monti, Pianoro (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 477 days.

(21) Appl. No.: 13/728,396

(22) Filed: Dec. 27, 2012

(65) Prior Publication Data

US 2013/0186042 A1 Jul. 25, 2013

(30) Foreign Application Priority Data

Jan. 19, 2012 (IT) ..... BO2012A0016

(51) Int. Cl.

| | |
|---|---|
| ***B65B 5/00*** | (2006.01) |
| ***B31B 5/80*** | (2006.01) |
| ***B65B 43/28*** | (2006.01) |
| ***B65B 43/08*** | (2006.01) |
| ***B65B 43/18*** | (2006.01) |
| ***B65B 43/30*** | (2006.01) |
| *B65B 35/20* | (2006.01) |
| *B65B 35/40* | (2006.01) |

(52) U.S. Cl.

CPC ... *B65B 5/00* (2013.01); *B31B 5/80* (2013.01); *B65B 43/08* (2013.01); *B65B 43/185* (2013.01); *B65B 43/285* (2013.01); *B65B 43/305* (2013.01); *B31B 2201/027* (2013.01); *B31B 2201/289* (2013.01); *B31B 2217/082* (2013.01); *B65B 35/20* (2013.01); *B65B 35/205* (2013.01); *B65B 35/40* (2013.01); *B65B 35/405* (2013.01)

(58) Field of Classification Search

CPC ..... B65B 5/00; B65B 5/04; B65B 5/06; B65B 1/04; B65B 35/20; B65B 35/205; B65B 35/40; B65B 35/405; B65G 47/845

USPC ..... 54/251, 252, 566, 235; 198/456, 463.2, 198/468.01, 474.1, 370.07, 370.02, 429

See application file for complete search history.

(56) References Cited

U.S. PATENT DOCUMENTS 3,821,874 A * 7/1974 Jones ..... 53/449
3,982,382 A * 9/1976 Vogel ..... 53/252

(Continued)

OTHER PUBLICATIONS

European Search Report for corresponding application No. EP12199418, completed Apr. 4, 2013, 3 pages.

*Primary Examiner* — Gloria R Weeks
*Assistant Examiner* — Eduardo R Ferrero
(74) *Attorney, Agent, or Firm* — R. Neil Sudol; Henry D. Coleman

(57) ABSTRACT

An article inserting apparatus has a first thrust plate and a first abutting blade. A first straight guide is fixed to the frame. A first member has a second straight guide. A first linear motor moves a first rod bearing the first thrust plate in an alternating motion, with a second member slidable along the second straight guide. A second linear motor moves a second rod with the first abutting blade in an alternating motion. The apparatus has a third hinged member, a fourth hinged member, a fifth hinged member, and a sixth hinged member. The third and fifth hinged members rotate to move the first member and the second member in synchrony with the first conveyor and the second conveyor, the first thrust plate and the first abutting blade driven by the first and second linear motors to insert an article into a box.

7 Claims, 11 Drawing Sheets

(56) References Cited

U.S. PATENT DOCUMENTS

| | | | | | |
|---|---|---|---|---|---|
| 4,982,556 | A * | 1/1991 | Tisma | 53/506 |
| 5,079,896 | A * | 1/1992 | Langen et al. | 53/54 |
| 5,081,816 | A * | 1/1992 | Cardinali | 53/54 |
| 5,175,976 | A * | 1/1993 | Petry et al. | 53/252 |
| 5,323,587 | A * | 6/1994 | Amaranti | 53/155 |
| 5,454,206 | A * | 10/1995 | Bailer et al. | 53/157 |
| 5,457,935 | A * | 10/1995 | Kope | 53/258 |
| 5,570,562 | A * | 11/1996 | Anderson | 53/250 |
| 5,657,610 | A * | 8/1997 | Dietrich et al. | 53/139.5 |
| 5,660,022 | A * | 8/1997 | Lade et al. | 53/252 |
| 5,768,854 | A * | 6/1998 | Nannini et al. | 53/252 |
| 5,809,751 | A * | 9/1998 | Braibanti | 53/543 |
| 6,308,502 | B1 * | 10/2001 | Olson et al. | 53/534 |
| 6,339,910 | B1 * | 1/2002 | Hahnel et al. | 53/258 |
| 6,354,060 | B1 * | 3/2002 | Pluschow et al. | 53/157 |
| 6,453,649 | B1 * | 9/2002 | Kammler et al. | 53/473 |
| 6,637,174 | B1 * | 10/2003 | Dietrich et al. | 53/252 |
| 6,889,485 | B2 * | 5/2005 | Davaillon | 53/443 |
| 7,299,604 | B2 * | 11/2007 | Kammler et al. | 53/451 |
| 7,455,636 | B2 * | 11/2008 | Leighton | 493/213 |
| 7,631,472 | B2 * | 12/2009 | Lidington | 53/252 |
| 7,654,062 | B2 * | 2/2010 | Mueller et al. | 53/251 |
| 2004/0025472 | A1 * | 2/2004 | Wieduwilt et al. | 53/250 |
| 2007/0044430 | A1 * | 3/2007 | Davi | 53/235 |
| 2007/0227101 | A1 * | 10/2007 | Simm | 53/473 |
| 2008/0184670 | A1 * | 8/2008 | Grabowski et al. | 53/252 |
| 2010/0307107 | A1 * | 12/2010 | Behringer | 53/266.1 |
| 2013/0180207 | A1 * | 7/2013 | Monti | 53/235 |

* cited by examiner

APPARATUS FOR INSERTING ARTICLES INTERNALLY OF BOXES

FIELD OF INVENTION

The present invention relates to the technical sector of apparatus for inserting of articles, such as blister packs containing tablets, internally of boxes.

DESCRIPTION OF THE PRIOR ART

An apparatus of known type for introducing articles internally of boxes is arranged by a side of a first conveyor which moves articles in an advancement direction and in a horizontal advancement direction. The first conveyor is of the belt type and transports the articles on an upper branch thereof, which articles can be for example blister packs containing tablets. The belt of the first conveyor is provided with pairs of lateral walls which each define a housing compartment for one or more articles stacked on one another.

A second conveyor is arranged by a side of the first conveyor, which second conveyor moves boxes in a same sense and direction of advancement as the first conveyor. The second conveyor is of a belt type and transports, on an upper branch thereof, empty boxes destined to be filled with the articles transported on the first conveyor. The belt of the second conveyor is provided with pairs of lateral wall which define abutments each for maintaining a box to be filled in position.

The apparatus is activated in synchrony with the first conveyor and the second conveyor so as to insert an article, or a stack of articles, internally of a box. The apparatus comprises a thrust plate for pushing an article, arranged in the housing compartment of the belt of the first conveyor, internally of a box arranged on the belt of the second conveyor, and an abutting blade destined to at least partially enter the box and supply an upper abutment for facilitating the insertion of the article in the box. The presence of the abutting blade is necessary where the articles have a limited resistance to buckling and might arch during the action of the thrust plate. An example of articles of this type are blister packs containing tablets.

The thrust plate and the abutting blade are activated by cam mechanisms having various drawbacks. In fact, they have a large number of components, are complicated to regulate, and are voluminous.

SUMMARY OF THE INVENTION

The aim of the present invention is to obviate the above drawbacks.

The above aim is obtained by an apparatus for inserting articles internally of boxes, which apparatus comprises a frame, which is positionable by a side of a first conveyor which moves articles in an advancement direction and in a horizontal advancement direction. The apparatus operates in synchrony with the first conveyor and with a second conveyor which is arranged by a side of the first conveyor and which moves boxes in a same sense and advancement direction as the first conveyor. The apparatus has a first thrust plate for pushing at least one article internally of a box, and a first abutting blade for at least partially entering the box and providing an upper abutment for facilitating insertion of the article in the box. The apparatus has a first straight guide solidly constrained to the frame, which straight guide is parallel to the advancement direction. A first member can slide along the first straight guide and is provided with a second straight guide that is vertical and perpendicular to the advancement direction. A first linear motor is borne by the first member. A first rod bears the first thrust plate and is moved by the first linear motor in order to move the first thrust plate in alternating motion in a horizontal and perpendicular direction to the advancement direction. A second member can slide along the second straight guide. A second linear motor is borne by the second member. A second rod bears the first abutting blade and is moved by the second linear motor so as to move in alternating motion in a horizontal and perpendicular direction to the advancement direction. A third member is hinged to the frame at a first hinge axis. A fourth member is hinged to the third member at a second hinge axis and to the second member at a third hinge axis. A fifth member is hinged to the frame at the first hinge axis. A sixth member is hinged to the fifth member at a fourth hinge axis and to the first member at a fifth hinge axis. The first hinge axis, the second hinge axis, the third hinge axis, the fourth hinge axis and the fifth hinge axis are horizontal and perpendicular to the advancement direction. The apparatus is positionable with respect to the first conveyor in such a way that the fourth member is downstream of the fifth member with respect to the advancement direction, the third member and the fifth member being activatable in rotation so as to move the first member and the second member in synchrony with the first conveyor and with the second conveyor and in order to enable movement of the first thrust plate and the first abutting blade by action respectively of the first linear motor and the second linear motor in order to insert at least one article internally of a box.

The combined use of members hinged to one another and linear motors for moving the first thrust plate and the first abutting blade has been seen to be particularly advantageous and has enable attaining the predetermined aim.

BRIEF DESCRIPTION OF THE DRAWINGS

Specific embodiments of the invention will be described in the following of the present invention, according to what is set down in the claims and with the aid of the appended tables of drawings, in which:

DESCRIPTION OF PREFERRED EMBODIMENTS

Figure 1:
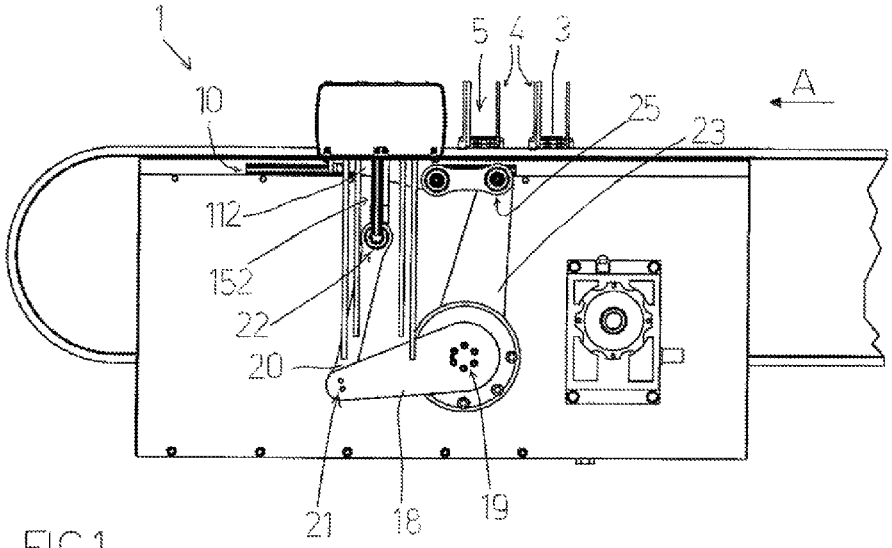
FIGS. 1, 2, 3 are respectively a side view, a front view and a first perspective view of the apparatus of the present invention, in a first operating step.

With reference to the accompanying tables of drawings, general reference numeral (1) denotes the apparatus for inserting articles in boxes, the object of the present invention.

The apparatus (1) is positionable by a side of a first conveyor (2) which moves articles (3) in an advancement direction (A) and in a horizontal advancement direction. The first conveyor (2) can be a belt and can transport the articles (3) on a relative upper branch thereof. The belt of the first conveyor (2) can be provided with pairs of lateral walls (4) which each define a housing compartment (5) for one or more articles (3), stacked on one another (in the example two blister packs (3) of tablets). In the illustrated example each housing compartment (5) receives two blister packs (3) of tablets which are stacked on one another.

A second conveyor (6) can be arranged by a side of the first conveyor (2), which second conveyor (6) moves boxes (7) in the same sense and direction of advancement as the first conveyor (2). The second conveyor (6) can be a belt and can transport empty boxes (7) on the upper branch thereof, destined to be filled with the articles (3) transported by the first conveyor (2). The belt of the second conveyor (6) can be provided with pairs of lateral walls (4) (not illustrated) which define abutments for each maintaining in position a box (7) to be filled. A fixed abutment (not illustrated) can also be provided, positioned by a side of the second conveyor (6) such as to abut the bottom of the boxes (7), such that the boxes (7) remain in position, for example, during the insertion of the blister packs (3) internally thereof.

The apparatus (1) is activatable in synchrony with the first conveyor (2) and with the second conveyor (6) such as to insert an article, or a stack of articles (3), internally of a box (7).

The apparatus (1) comprises a frame (8), a first thrust plate (9) for pushing at least an article internally of a box (7), and a first abutting blade (36) for at least partially entering the box (7) and providing an upper abutment for facilitating insertion of the article (3) in the box (7).

As mentioned in the preamble, the presence of the first abutting blade (34) is necessary where the articles (3) have a limited resistance to buckling and might arch during the action of the thrust plate (9). An example of this type of article (3) is the blister pack (3) containing tablets, illustrated in the appended figures, but might also be floppy packs containing liquid or granular or powder substances.

The apparatus (1) further comprises a first straight guide (10) solidly constrained to the frame (8), which straight guide is parallel to the advancement direction. A first member (11) can slide along the first straight guide (10) and is provided with a second straight guide (12) that is vertical and perpendicular to the advancement direction. A first linear motor (13) is borne by the first member (11). A first rod (14) bears the first thrust plate (9) and is moved by the first linear motor (13) in order to move the first thrust plate (9) in an alternating motion in a horizontal and perpendicular direction to the advancement direction. A second member (15) can slide along the second straight guide (12). A second linear motor (16) is borne by the second member (15). A second rod (17) bears the first abutting blade (34) and is moved by the second linear motor (16) so as to move in an alternating motion in a horizontal and perpendicular direction to the advancement direction. A third member (18) is hinged to the frame (8) at a first hinge axis (19). A fourth member (20) is hinged to the third member (18) at a second hinge axis (21) and is hinged to the second member (15) at a third hinge axis (22). A fifth member (23) is hinged to the frame (8) at the first hinge axis (19). A sixth member (24) is hinged to the fifth member (23) at a fourth hinge axis (25) and is hinged to the first member (11) at a fifth hinge axis (35). The first hinge axis (19), the second hinge axis (21), the third hinge axis (22), the fourth hinge axis (25) and the fifth hinge axis (35) are horizontal and perpendicular to the advancement direction.

The apparatus (1) is positionable with respect to the first conveyor (2) in such a way that the fourth member (20) is downstream of the fifth member (23) with respect to the advancement direction (A).

The third member (18) and the fifth member (23) are activatable in rotation so as to move the first member (11) and the second member (15) in synchrony with the first conveyor (2) and with the second conveyor (6) and in order to enable movement of the first thrust plate (9) and the first abutting blade (34) by action respectively of the first linear motor (13) and the second linear motor (16) in order to insert at least an article internally of a box (7).

The first member (11) can form a first housing (30). The first linear motor (13) can thus be housed internally of the first housing (30).

The second member (15) can form a second housing (31). The second linear motor (16) can therefore be housed internally of the second housing (31). The first member (11) can comprise: a first support structure (111) which forms a first housing (30) (FIG. 4) and the second straight guide (12), and a first carriage (112) which is fixed to the first support structure (111) and which can slide along the first straight guide (10) (FIG. 15).

Figure 5:
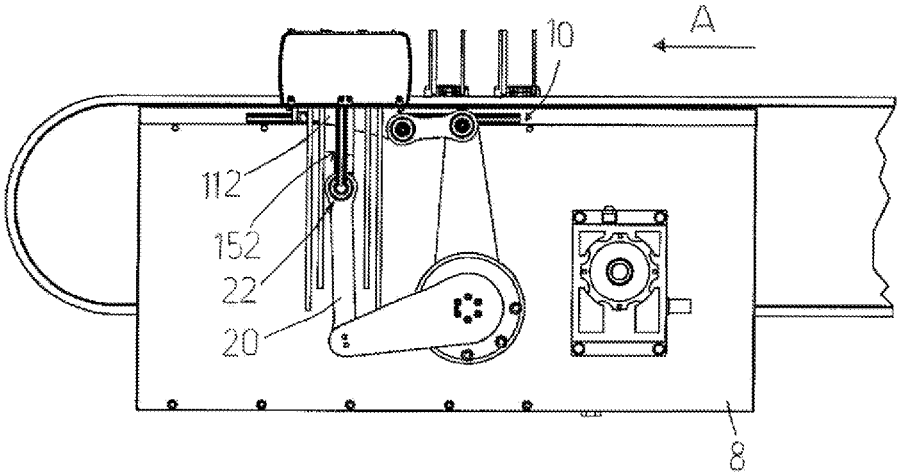
FIGS. 5, 6, 7 are respectively a lateral view, a front view and a first perspective view of the apparatus of the present invention, in a second operating step.
Figure 6:
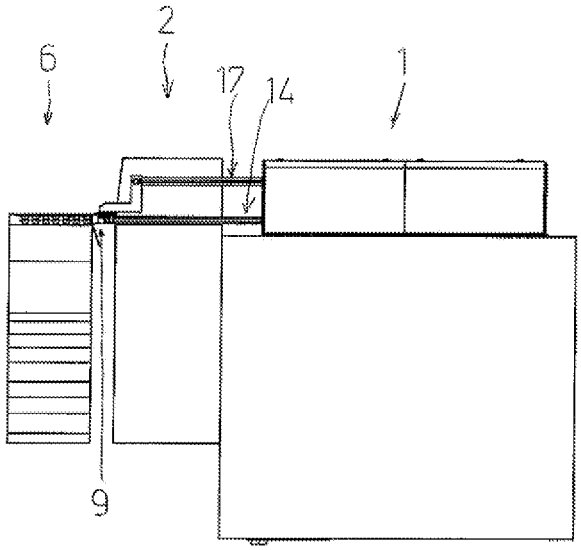
Figure 7:
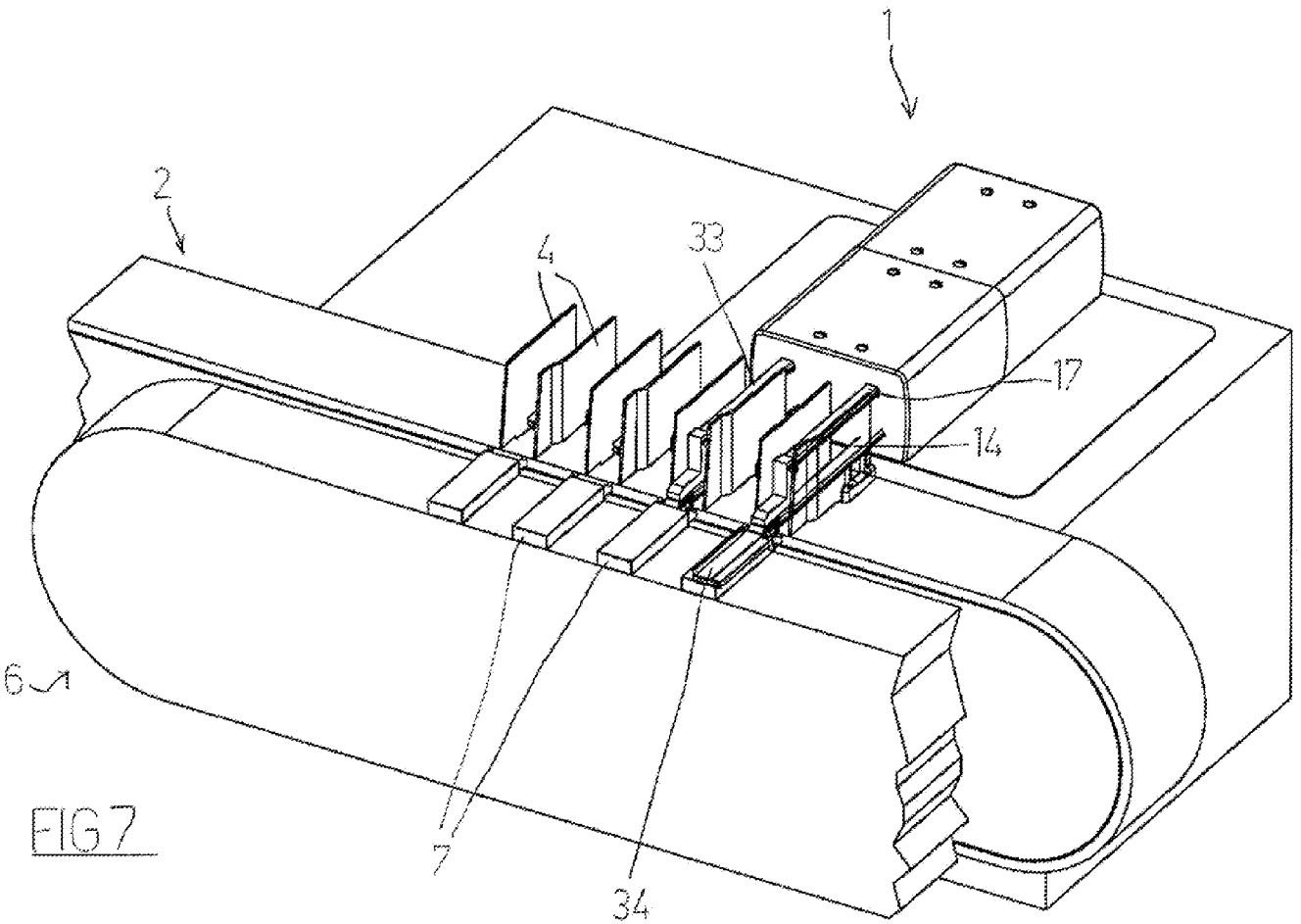
Figure 8:
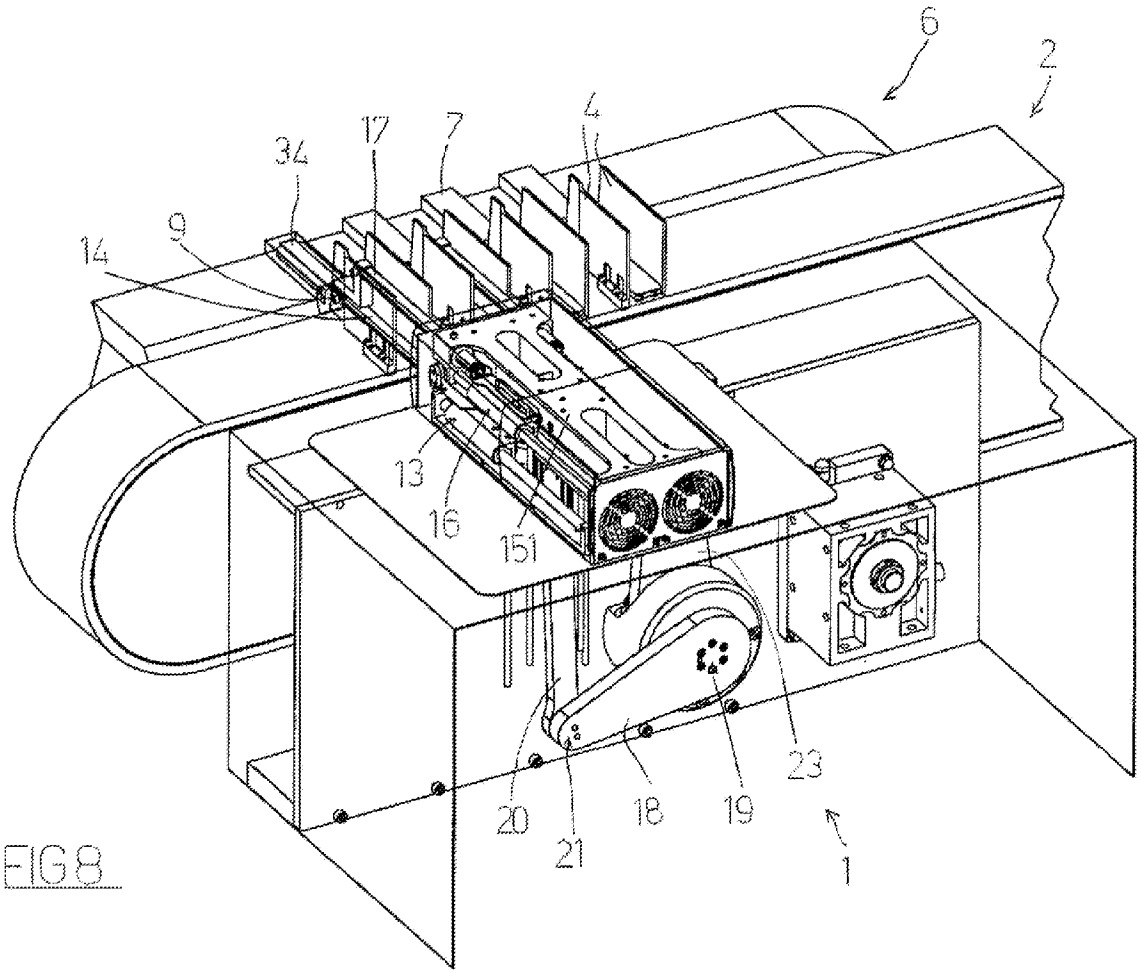
FIG. 8 is a second perspective view, alike to the perspective view of FIG. 7, in which some parts are "transparent"

The second member (15) comprises a second support structure (151) which conforms a second housing (31), and a second carriage (152) (FIG. 15) which can slide along the second straight guide (12). The second carriage (152) can be hinged to the fourth member (20) at the third hinge axis (22) (FIG. 5).

Figure 4:
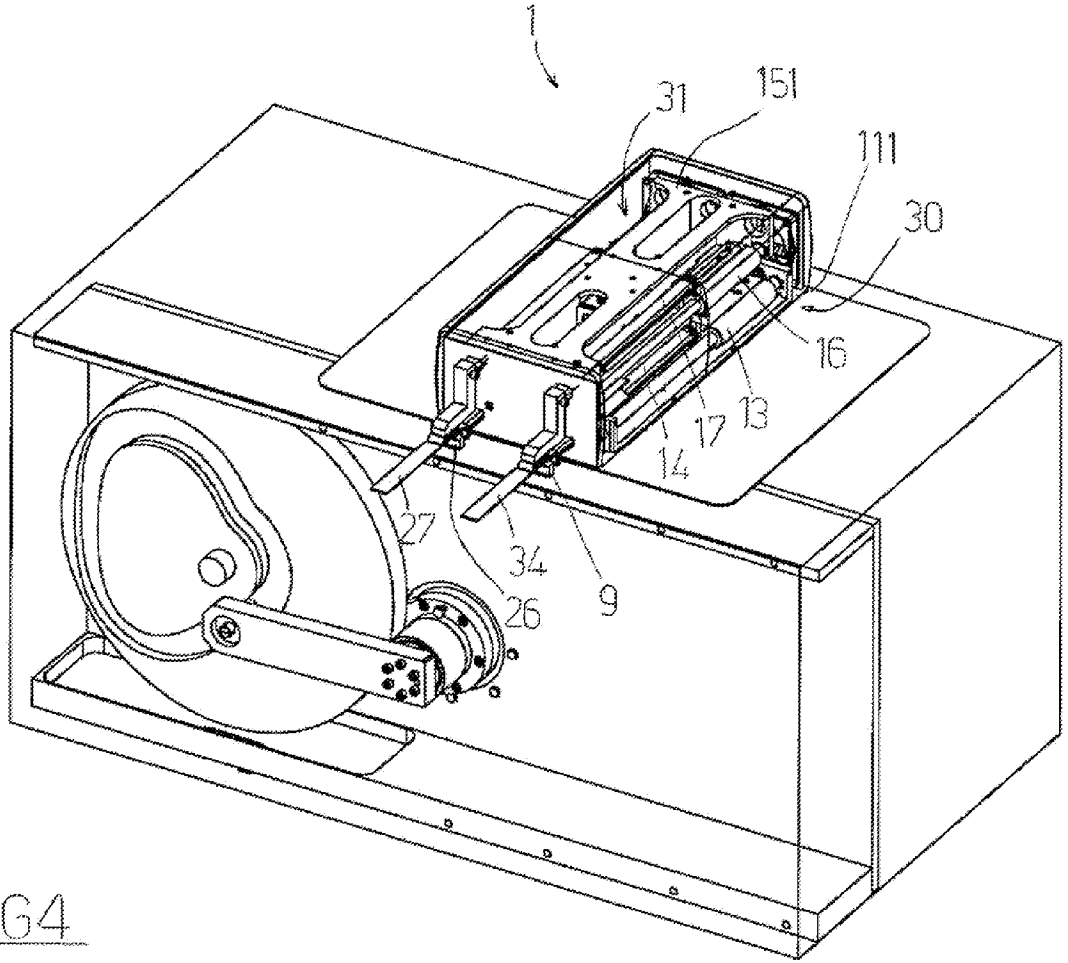
FIG. 4 is a second perspective view, alike to the perspective view of FIG. 3, in which some parts are "transparent"
Figure 15:
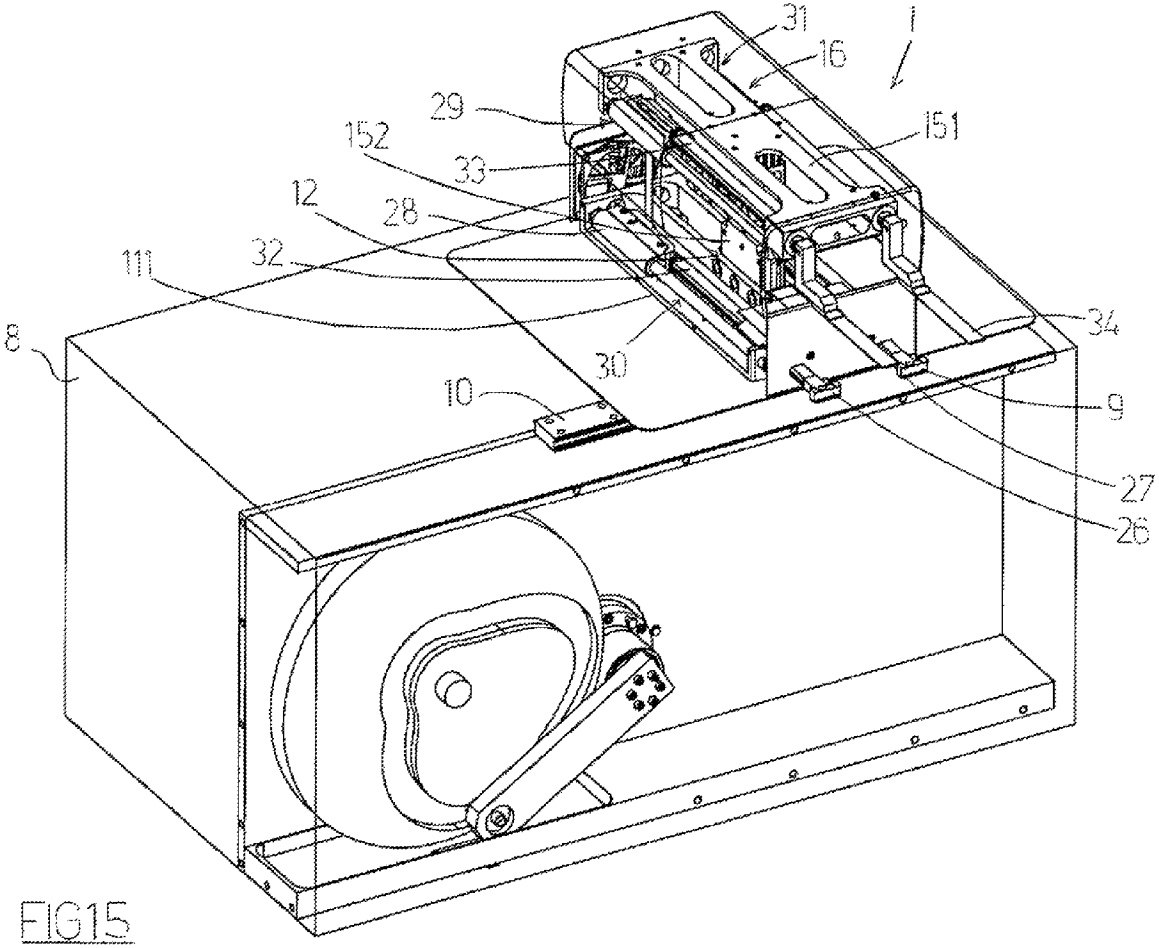
FIG. 15 is a second perspective view alike to the perspective view of FIG. 14, wherein some parts are "transparent".

The first housing (30) of the first member (11) can also receive the second member (15) (compare FIGS. 4 and 15).

The second member (15) can slide along the second straight guide (12), by means of the slide carriage (152) between two end positions. In a first position (FIG. 4), the second member (15) is arranged in the first housing (30) of the first member (11), while in a second position (FIG. 15), the second member (15) is arranged above the first member (11) at a height such that the first abutting blade (34) passes over the walls (4) of the first conveyor (2).

The second support structure (151) of the second member (15) can be designed so as to bear mainly the second linear motor (16), the second rod (17) and the first abutting blade (34), with the aim of minimizing the weight of the mechanical components which have to slide along a second straight guide (12) and perform vertical runs. The first linear motor (13), the first rod (14) and the first thrust plate (9) are instead solidly constrained to the first member (11) as it is not necessary for them to perform straight runs.

Thus the mechanical inertia of the second member (15) and the mechanical components borne thereby is advantageously minimized, which enables making the functioning of the apparatus (1) more rapid and reducing the energy demanded in order to activate the apparatus (1) itself.

The figures illustrate an operating cycle of the apparatus (1) of the invention, which occurs in synchrony with the functioning of the first conveyor (2) and the second conveyor (6).

Figure 2:
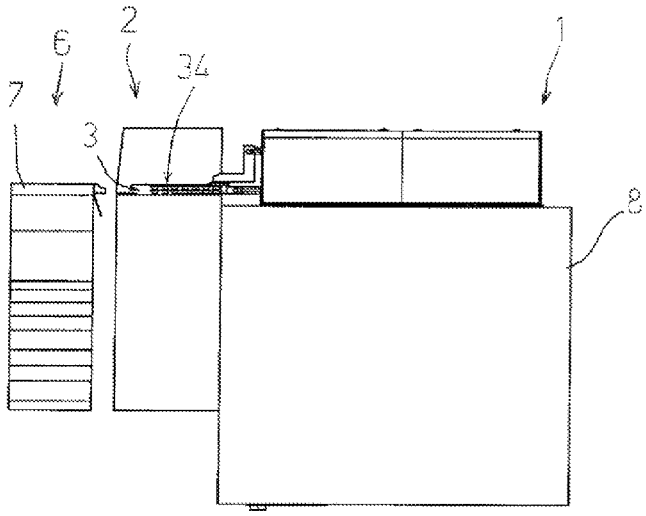
Figure 3:
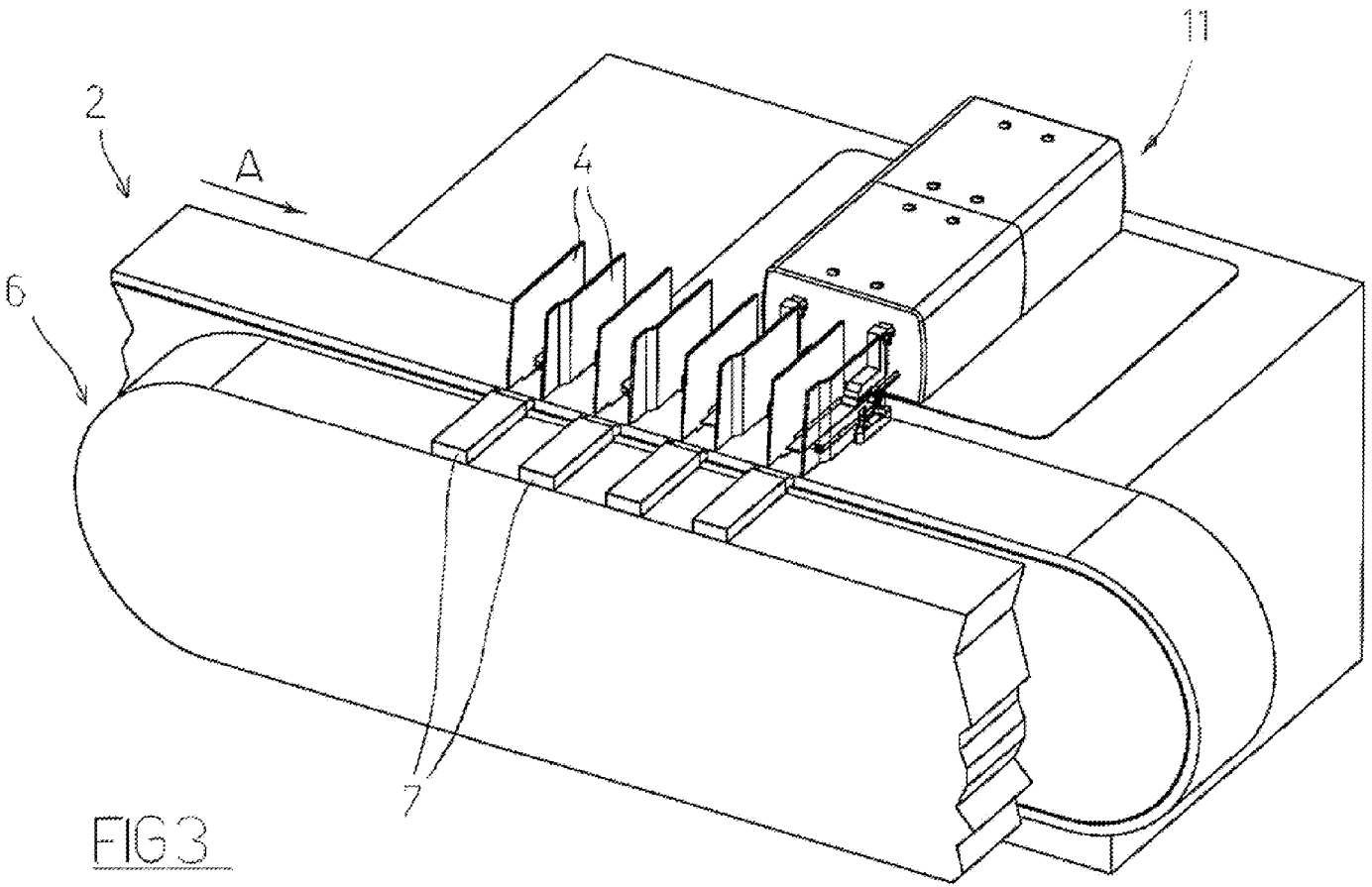

FIGS. 1-4 show a first operating step of the apparatus (1), in which the first abutting blade (34) is interposed between a pair of lateral walls (4) of the first conveyor (2) and is arranged above a pair of stacked blister packs (3) (FIG. 2).

The first thrust plate (9) and the first abutting blade (34) are then activated respectively so as to push the pair of blister packs (3) internally of a corresponding empty box (7) and to provide a constant upper abutment to the pair of blister packs (3) with the aim of ensuring introduction of the pair of blister packs (3) into the box (7), see FIGS. 5-8 (second operating step). The first abutting blade (34) therefore prevents the pair of blister packs (3) from arching, which might prejudice the correct inserting of the pair of blister packs (3) in the box (7). A support plane is for example provided between the first conveyor (2) and the second conveyor (6), not illustrated, such as to enable the transfer of the pair of blister packs (3) from the housing compartment (5) of the first conveyor (2) to the box (7) which is on the second conveyor (6).

Figure 9:
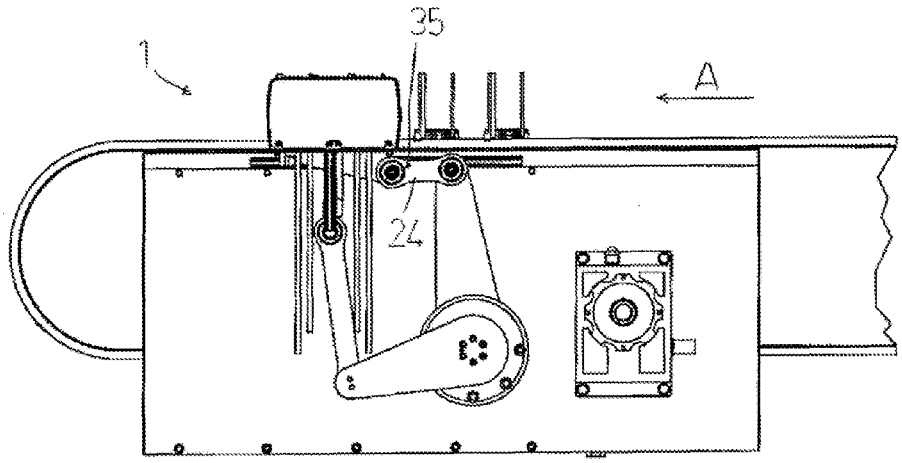
FIGS. 9, 10, 11 are respectively a lateral view, a front view and a first perspective view of the apparatus of the present invention, in a third operating step.
Figure 10:
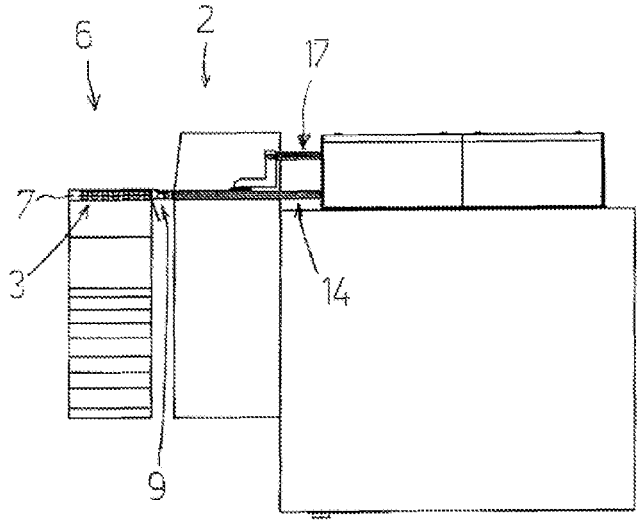
Figure 11:
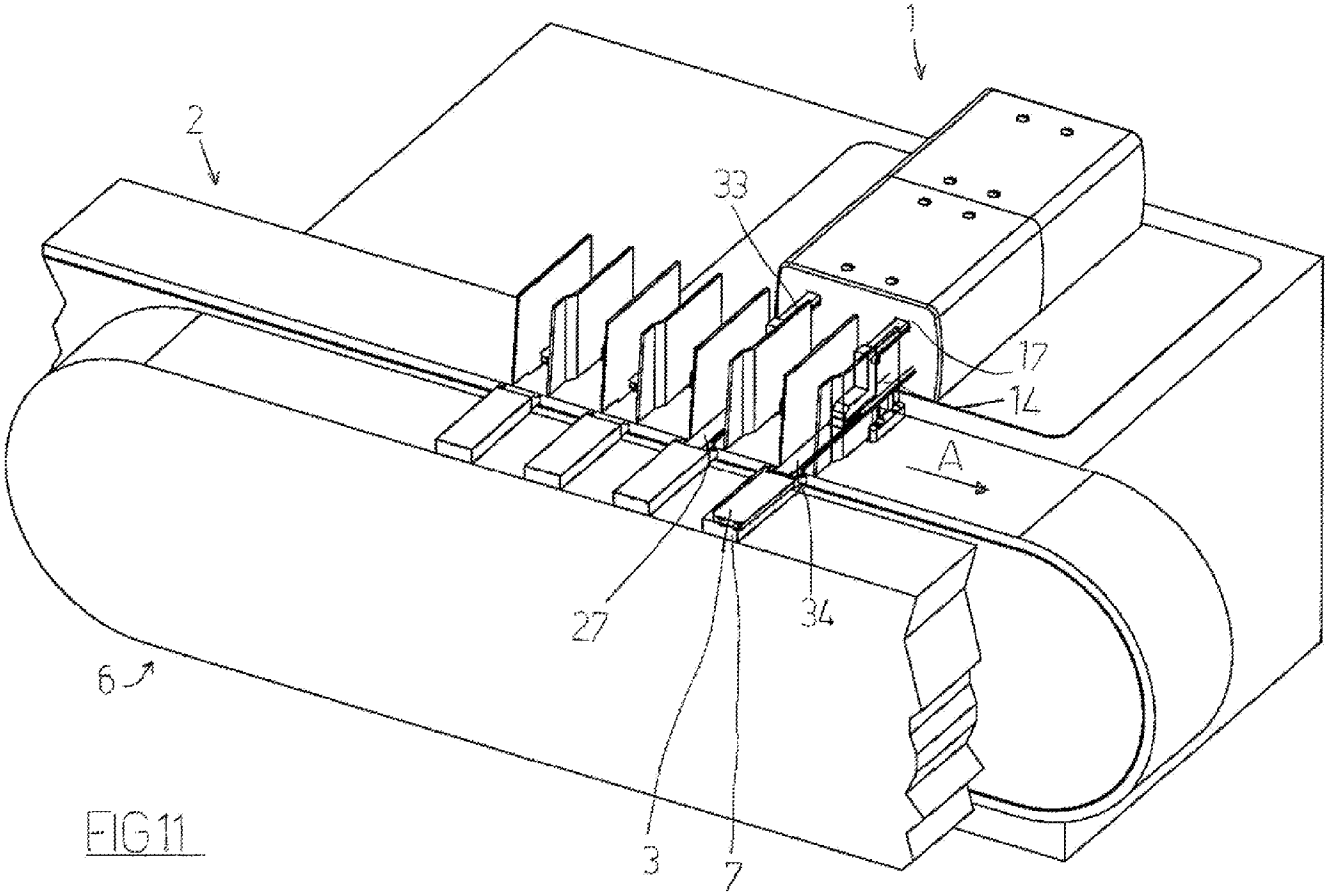
Figure 12:
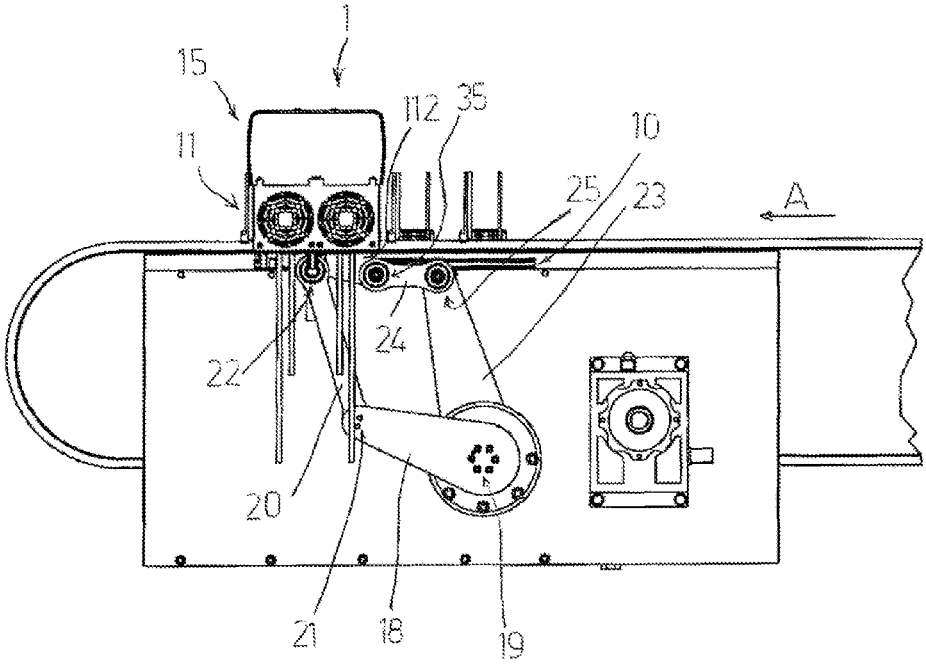
FIGS. 12, 13, 14 are respectively a lateral view, a front view and a first perspective view of the apparatus of the present invention, in a fourth operating step which concludes an operating cycle of the apparatus.
Figure 13:
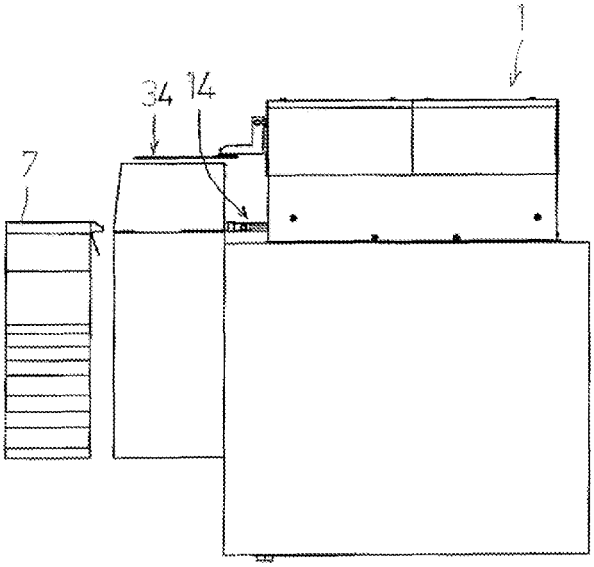
Figure 14:
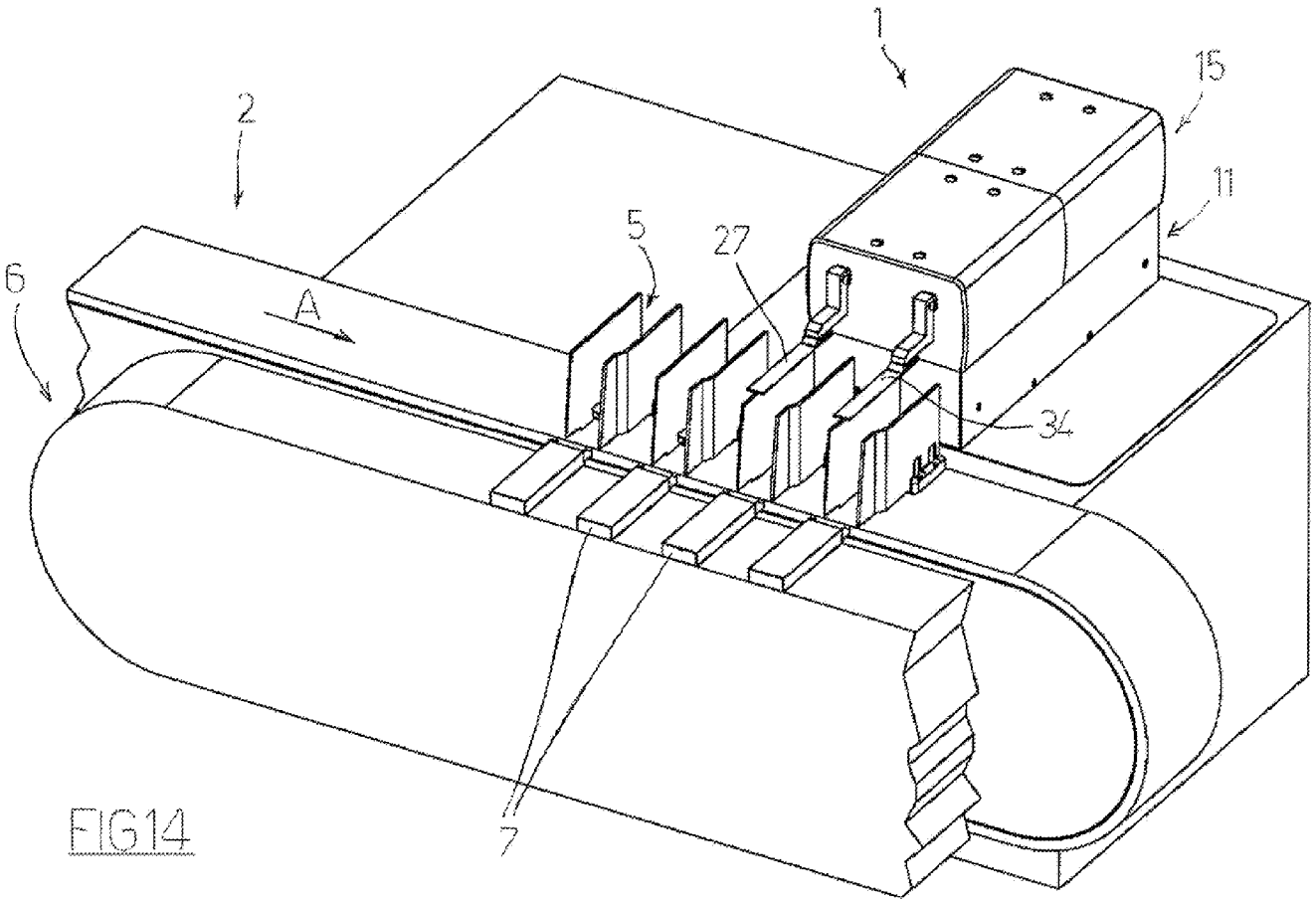

Once the pair of blister packs (3) has been inserted into the box (7), the first abutting blade (34) is retracted such that it exits from the box (7) while the first thrust plate (9) is maintained in position to abut the pair of blister packs (3) internally of the box (7) and prevent the exiting of first abutting blade (34) from accidentally causing also an even partial exiting of the pair of blister packs (3); see FIGS. 9-11, third operating step.

Lastly, the apparatus (1) has to be moved in such a way as to be predisposed to transfer a further pair of blister packs (3) arranged on the first conveyor (2) internally of a box (7) arranged on the second conveyor (6). In order to do this, the first abutting blade (34) has to be raised to a higher level than the lateral walls (4) of the first conveyor (2) (and therefore the second member (15) has to slide along the second straight guide (12) upwards) and the first member (11) (which bears the second member (15) and therefore also the second linear motor (16), the second rod (17) and the first abutting blade (34)) has to be moved along the first straight guide (10) in order to displace towards a further housing compartment (5) containing a pair of blister packs (3) to be transferred (FIGS. 12-15), fourth operating step) internally of an empty box (7). Thus a new operating cycle for the apparatus (1) starts.

In accordance with the embodiment illustrated in the figures, the apparatus (1) further comprises a second thrust plate (26) (FIG. 4) for pushing at least one article internally of a box (7), a second abutting blade (27) for at least partially entering the box (7) and providing an upper abutment to facilitate entry of the article into the box (7), and a third linear motor (28) which is housed in the first housing (30) of the first member (11). A fourth linear motor (29) is housed in the second housing (31) of the second member (15). A third rod (32) bears the second thrust plate (26) and is moved by the third linear motor (28) such as to move alternatingly in a horizontal direction that is perpendicular to the advancement direction. A fourth rod (33) bears the second abutting blade (27) and is moved by the fourth linear motor (29) such as to move alternatingly in a horizontal and perpendicular direction to the advancement direction. The above considerations regarding the functioning of the apparatus (1) are valid also in reference to this embodiment, it being understood that the first housing (30) and the second housing (31) can also house a greater number of linear motors for moving abutting blades and thrust plates with the aim of contemporaneously introducing a plurality of pair of blister packs (3) internally of the empty boxes (7).

The above has been described by way of non-limiting example, and any eventual constructional variations are understood to fall within the protective scope of the present technical solution, as claimed in the following.

The invention claimed is:

1. An apparatus for inserting articles (3) internally of boxes (7), which apparatus (1) comprises:

a frame (8) positionable by a side of a first conveyor (2) which moves articles (3) in an advancement direction (A) and in a horizontal advancement direction, operated in synchrony with the first conveyor (2) and with a second conveyor (6) which is arranged by a side of the first conveyor (2) and which moves boxes (7) in a same sense and advancement direction as the first conveyor (2);

a first thrust plate (9) for pushing at least one article internally of a box (7);

a first abutting blade (36) for at least partially entering the box (7) and providing an upper abutment for facilitating insertion of the article (3) in the box (7);

a first straight guide (10) solidly constrained to the frame (8), which straight guide is parallel to the advancement direction;

a first member (11) which can slide along the first straight guide (10) and which is provided with a second straight guide (12) that is vertical and perpendicular to the advancement direction;

a first linear motor (13) which is borne by the first member (11);

a first rod (14) which bears the first thrust plate (9) and which is moved by the first linear motor (13) in order to move the first thrust plate (9) in an alternating motion in a horizontal and perpendicular direction to the advancement direction;

a second member (15) which can slide along the second straight guide (12);

a second linear motor (16) which is borne by the second member (15);

a second rod (17) which bears the first abutting blade (34) and which is moved by the second linear motor (16) so as to move in an alternating motion in a horizontal and perpendicular direction to the advancement direction;

a third member (18) which is hinged to the frame (8) at a first hinge axis (19);

a fourth member (20) which is hinged to the third member (18) at a second hinge axis (21) and which is hinged to the second member (15) at a third hinge axis (22);

a fifth member (23) which is hinged to the frame (8) at the first hinge axis (19);

a sixth member (24) which is hinged to the fifth member (23) at a fourth hinge axis (25) and which is hinged to the first member (11) at a fifth hinge axis (35);

the first hinge axis (19), the second hinge axis (21), the third hinge axis (22), the fourth hinge axis (25) and the fifth hinge axis (35) being horizontal and perpendicular to the advancement direction;

the apparatus (1) being positionable with respect to the first conveyor (2) in such a way that the fourth member (20) is downstream of the fifth member (23) with respect to the advancement direction (A);

the third member (18) and the fifth member (23) being activatable in rotation so as to move the first member (11) and the second member (15) in synchrony with the first conveyor (2) and with the second conveyor (6) and in order to enable movement of the first thrust plate (9) and the first abutting blade (34) by action respectively of the first linear motor (13) and the second linear motor (16) in order to insert at least an article internally of a box (7).

2. The apparatus (1) of claim 1, wherein the first member (11) comprises a first support structure (111) which forms a first housing (30) and the second straight guide (12); and, a first carriage (112) which is fixed to the first support structure (111) and which can slide along the first straight guide (10).

3. The apparatus of claim 2, wherein the first housing (30) receives the first linear motor (13) and the second member (15).

4. The apparatus of claim 1, wherein the second member (15) comprises a second support structure (151) which conforms a second housing (31), and a second carriage (152) which can slide along the second straight guide (12).

5. The apparatus of claim 4, wherein the second housing (31) receives the second linear motor (16).

6. The apparatus of claim 4, wherein the second carriage (152) is hinged to the fourth member (20) at the third hinge axis (22).

7. The apparatus of claim 5, wherein the second carriage (152) is hinged to the fourth member (20) at the third hinge axis (22).

* * * * *